United States Patent [19]

Dougherty

[11] 4,317,064

[45] Feb. 23, 1982

[54] SHADOW MASK SUSPENSION SYSTEM

[75] Inventor: Lawrence W. Dougherty, Sleepy Hollow, Ill.

[73] Assignee: Zenith Radio Corporation, Glenview, Ill.

[21] Appl. No.: 84,708

[22] Filed: Oct. 15, 1979

[51] Int. Cl.[3] ..... H01J 29/07

[52] U.S. Cl. ..... 313/406; 313/407

[58] Field of Search ..... 313/404, 406, 407, 405

[56] References Cited

U.S. PATENT DOCUMENTS

| | | | |
|---|---|---|---|
| 3,330,980 | 7/1967 | Shrader . | |
| 3,601,650 | 8/1971 | Pappadis | 313/407 X |
| 3,743,878 | 7/1973 | Kautz et al. | 313/404 X |
| 3,986,072 | 10/1976 | Adamski | 313/404 |
| 4,100,451 | 7/1978 | Palac | 313/404 |

*Primary Examiner*—Palmer C. Demeo

*Attorney, Agent, or Firm*—Ralph E. Clarke, Jr.

[57] ABSTRACT

A color cathode ray tube is depicted which has a faceplate and a shadow mask mounted in precise relationship to the faceplate by a plurality of suspension devices spaced on the periphery of the faceplate. The suspension devices provide for rigidly and stably suspending the mask. Each suspension device comprises a stud extending from the faceplate and a leaf spring formed to support and space the mask in proper relationship to the faceplate with the spring having a first end formed for detachable engagement to the stud. A bracket or frame attached to the mask has a seat for receiving in permanent attachment the second end of the spring. The suspension device is characterized by the spring and bracket or frame having configurations at their interface which are such that the lateral edges of the spring are compressively preloaded against the bracket or frame to provide a wide stance, which enhances the stability of the suspension of said mask in relation to said faceplate.

2 Claims, 9 Drawing Figures

SHADOW MASK SUSPENSION SYSTEM

BACKGROUND OF THE INVENTION

This invention relates to color cathode ray tubes of the type having a shadow mask, and especially to systems for suspending shadow masks of various types in cathode ray tubes.

A color cathode ray tube may be of the type which has a shadow mask assembly that includes a heavy frame to which is welded a dished, apertured mask. The mask-frame assembly is precisely mounted in relation to the tube faceplate by a suspension system comprising three or four leaf springs which are welded to the frame at spaced points around the periphery thereof. The springs have apertures at their distal ends which engage studs extending from the tube faceplate. The assembly is capable of being demounted from the faceplate and precisely remounted by depressing the springs to disengage or re-engage the studs.

The relatively heavy weight and costlines of this type of mask-frame assembly has led to the invention of a low cost, light weight, non-self-rigid, torsionally flexible shadow mask preferably of a one-piece frameless construction. A shadow mask of this type is disclosed in U.S. Pat. No. 4,100,451 to Palac, of common ownership herewith. Because of the lack of the frame in a mask of this type, the attachment of the springs to the mask is primarily by means of relatively stiff brackets which embrace the mask, and to which the brackets are welded. The suspension springs in turn are welded to suitable areas of the brackets. The bracket means of attachment provides for stiffening of the shadow mask due to the rigidity of the brackets. Also, the pressure exerted by the springs where the mask is in the mounted position, and when the mask is demounted and remounted, is absorbed by the brackets so that the non-self rigid mask is not distorted.

It is essential to the stability of the shadow mask that the point of attachment of the spring either to the frame of a mask-frame assembly or to a bracket attached to a frameless mask be stable; that is, the spring must not rock, twist or otherwise displace in relation to the point of attachment except for the intentional flexure required for demounting and remounting. The entire suspension system, including the point of attachment of the spring to the mask frame or bracket, must precisely fix and hold a predetermined spatial position of the mask as a whole relative to the faceplate against translational or rotational displacement, this in spite of any thermal expansion or contraction of the mask, frictional restraint during demounting and remounting of the mask, mechanical shocks or force of gravity.

The means for forming the permanent attachment at the interface of spring and bracket, normally spot welding, can exacerbate the displacement problem. Spot welding tends to "dimple" the parts at the interface, with the result that the parts are in contact only at the weld points. The relatively short distance between the weld points (as compared to the total width of the spring) constitutes a relatively narrow baseline upon which the spring can more readily rock or twist in relation to the bracket or frame.

OBJECTS OF THE INVENTION it is a general object of this invention to provide an improved shadow mask suspension means for color cathode ray picture tubes.

It is another general object of this invention to provide an improved mask suspension means that will aid in maintaining the shadow mask assembly and associated faceplate in proper registry.

It is a more specific object to provide a suspension means which aids in precisely fixing and holding a predetermined spatial position of the mask relative to the faceplate position against translational and rotational displacement in spite of any thermal expansion or contraction of the mask during processing or operation of the tube, frictional restraint during demounting and remounting of the mask, mechanical shocks, or force of gravity.

BRIEF DESCRIPTION OF THE DRAWINGS

The features of the present invention which are believed to be novel are set forth with particularity in the appended claims. The invention, together with further objects and advantages thereof, may best be understood by reference to the following description taken in conjunction with the accompanying drawings, in the several figures of which like reference numerals identify like elements, and in which:

DESCRIPTION OF THE PREFERRED EMBODIMENTS

The invention is for use in a color cathode ray tube having a faceplate and a shadow mask mounted in precise relationship to the faceplate. The mounting means comprise a plurality of suspension devices spaced on the periphery of the faceplate for rigidly and stably suspending the mask.

Figure 1:
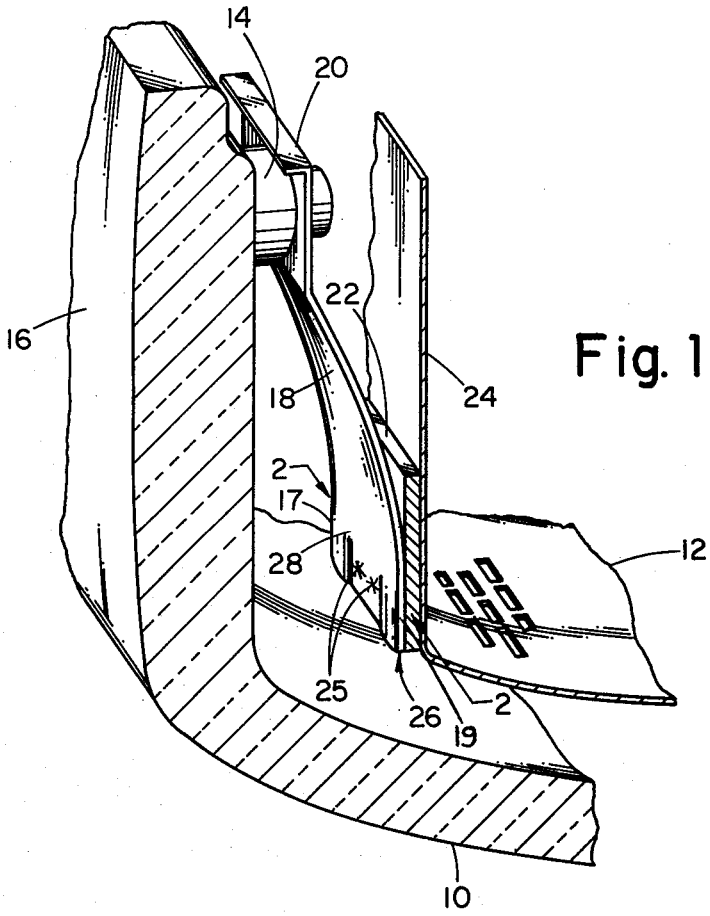
FIG. 1 is a view in perspective showing partially in section a fragment of a picture tube faceplate and an associated suspension device according to the invention for a frameless shadow mask.

FIG. 1 shows in perspective a view which will be readily recognizable to those skilled in the art as comprising a representative section of a faceplate 10 and an adjacently mounted shadow mask 12. Mask 12 is indicated as being the non-self-rigid, torsionally flexible, frameless type. The suspension device comprises a stud 14 shown as extending from the flange 16 of faceplate 10. A leaf spring 18 formed to support and space mask 12 in proper relationship to faceplate 10 is shown as having a first end 20 formed for detachable engagement to stud 14.

The suspension device is shown as including a bracket 22 attached to the rearwardly extending skirt 24 of the mask 12. Bracket 22 has a seat 26, the location of which is indicated by the arrow. Seat 26 provides for receiving in permanent attachment as by welding the second end 28 of spring 18, with weld points 25 as indicated.

Figure 2:
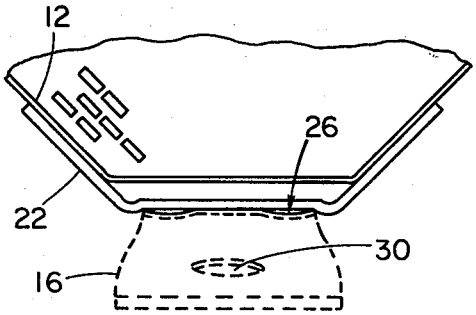
FIG. 2 is a view looking downwardly at a section taken along lines 2—2 of FIG. 1 and showing component interface configurations according to the invention.

The suspension device according to the invention is characterized by the spring 18 and the bracket 22 having configurations at their interface which are such that the lateral edges 17 and 19 of spring 18 are compressively preloaded against seat 26 of bracket 22 to provide a wide stance which enhances the stability of the suspension of mask 12 in relation to faceplate 10 against normal twisting forces arising from a variety of causes such as gravity, friction, inertia, etc. The configurations of spring 18 and the bracket 22 at their interface in the area of seat 26 of spring 18 may be as depicted in FIG. 2. Bracket 22 is shown as embracing shadow mask 12 in a corner section of the faceplate. Aperture 30, visible in this view, provides for detachable engagement with the stud (not shown).

Figure 3A:
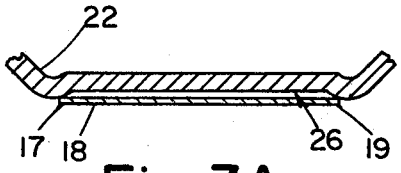
FIGS. 3A–B, 4A–B and 5A–B are plan views in section depicting in detail component interface configurations according to the invention.
Figure 3B:
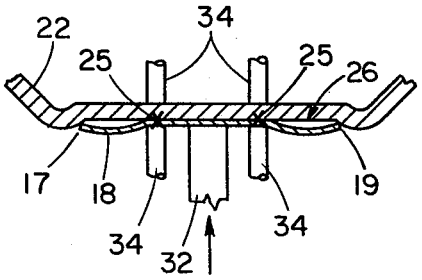

The configurations of spring 16 and bracket 22 at their interface which characterizes the suspension device according to the invention is shown in greater detail by FIGS. 3A and 3B which indicate respective configurations before and after permanent attachment. It will be noted that the configuration of seat 26 of bracket 22 at the interface has the form of a concavity, while spring 18 is shown as being straight at the interface. The means for permanent attachment of spring 18 to seat 26 of bracket 22 are depicted in FIG. 3B. A force in the direction of the associated arrow may be applied by a shoe 32 which depresses spring 18 and clamps the central area of the spring firmly against seat 26 of bracket 22. Spot welding electrodes 34 also apply pressure on the spring, and when electrically energized, electrodes 34 bond the parts permanently together by spot weldments indicated by weld points 25. As a result, the lateral edges 17 and 19 of spring 18 are compressively preloaded against bracket 22 to provide a wide stance according to the invention. The result is the enhancement of the stability of the suspension of the mask in relation to the faceplate.

Figure 4A:
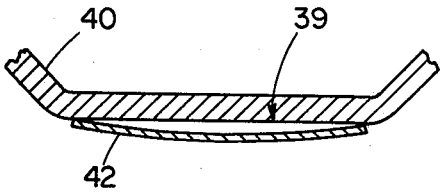
Figure 4B:
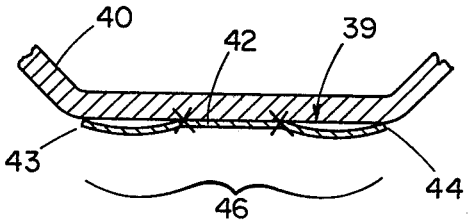

The configurations of the spring and the bracket which provide the wide stance according to the invention are not limited to those shown in the foregoing figures. For example, as shown FIGS. 4A and 4B, the seat 39 for bracket 40 may be flat and the spring 42 may be formed to oppose at their interface a concavity to the seat 39 of bracket 40, as shown. When permanently bonded by the means described in connection with FIG. 3B, the lateral edges 43 and 44 of spring 42 are compressively preloaded against the seat 39 of bracket 40 to provide a wide stance 46 according to the invention, with the width of the stance being as indicated by the brace symbol in FIG. 4B.

Figure 5A:
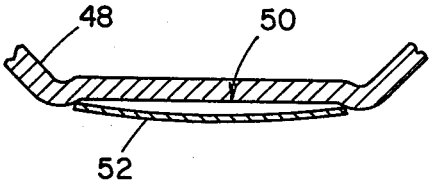
Figure 5B:
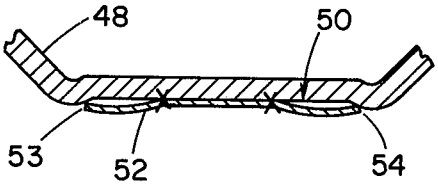

Other feasible configurations of the spring and the bracket which can provide for attachment according to the principles of the invention are shown in FIGS. 5A and 5B. Bracket 48 is shown as having a seat 50 formed as a concavity or dent. Spring 52 is also formed to have an opposing concavity. When permanently bonded according to the means described heretofore, the lateral edges 53 and 54 of spring 52 will be seen to be compressively preloaded against seat 50 of bracket 48 to provide the wide stance according to the invention.

Figure 6:
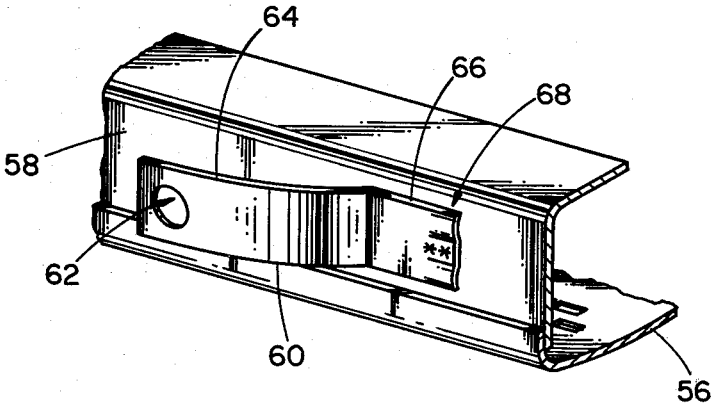
FIG. 6 is a view in perspective of a suspension device according to the invention as applied to a shadow mask having a frame.

Application of the invention is not limited to suspension devices for suspending the non-self-rigid, frameless shadow mask depicted by the FIGS. 1 and 2. FIG. 6 is a depiction of a shadow mask 56 having a rigid frame 58. A leaf spring 60 formed to support and space mask 56 in proper relationship to an associated faceplate (not shown) is shown as extending from frame 58. An aperture 62 is provided in a first end 64 of spring 58 for detachable engagement to an associated stud. The second end 66 of the spring 60 is shown as being permanently attached to a seat 68 on frame 58 for receiving second end 66 of spring 60. Spring 60 and the seat 68 of frame 58 are indicated as having configurations at their interface which, when permanently attached, are such that the lateral edges of spring 66 are compressively preloaded against frame 56 to provide a wide stance according to the invention. The configurations of spring 60 and frame 58 at their interface are indicated as being the configuration depicted by FIGS. 4A and 4B wherein a spring is formed as a concavity opposed to a seat having a flat surface. The configurations of the spring 60 and frame 58 at their interface could as well be those depicted in FIGS. 3A and 5A.

Ways to form the seat of the bracket (or the seat of the frame) and the end of the spring for permanent attachment according to the invention will readily suggest themselves those skilled in the metal-forming art. The seat in a frame, for example, can be formed by "denting" the frame with a suitable die set, or by means of a mated punch and anvil. The seat in a bracket can be similarly formed. Alternately, the seat in a frame can be formed by a machining process, such as by milling. The configuration of the spring can be formed easily during the stamping process by a simple modification of the forming die.

Other changes may be made in the above-described apparatus without departing from the true spirit and scope of the invention herein involved. It is intended therefore that the subject matter of the foregoing depictions shall be interpreted as a illustrative and not in a limiting sense.

I claim:

1. For use in a color cathode ray tube having a faceplate and a shadow mask mounted in precise relationship to said faceplate by a plurality of suspension devices spaced on the periphery of said faceplate for rigidly and stably suspending said mask, each suspension device comprising:

a stud extending from said faceplate;

a leaf spring formed to support and space said mask in proper relationship to said faceplate, said spring having a first end formed for detachable engagement to said stud;

a bracket attached to said mask and having a seat for receiving in permanent attachment the second end of said spring;

said suspension device being characterized by said spring and said bracket having configurations at their interface which are such that the lateral edges of said spring are compressively preloaded against said bracket to provide a wide stance which enhances the stability of the suspension of said mask in relation to said faceplate.

2. For use in a color cathode ray tube having a faceplate and a shadow-mask-and-frame assembly mounted in precise relationship to said faceplate by a plurality of suspension devices spaced on the periphery of said faceplate for rigidly and stably suspending said mask, each suspension device comprising:

a stud extending from said faceplate;

a leaf spring formed to support and space said mask in proper relationship to said faceplate, said spring having a first end formed for detachable engagement to said stud, and a second end formed for permanent attachment to said frame of said shadow mask and frame assembly;

said suspension device being characterized by said spring and said frame having configurations at their interface which are such that the lateral edges of said spring are compressively preloaded against said frame to provide a wide stance which enhances the stability of the suspension of said mask and frame assembly in relation to said faceplate.

* * * * *